US008286732B2

(12) United States Patent
Walker et al.

(10) Patent No.: US 8,286,732 B2
(45) Date of Patent: Oct. 16, 2012

(54) STEERING COMPONENT, STEERING ASSEMBLY AND METHOD OF STEERING A DRILL BIT IN A BOREHOLE

(75) Inventors: Colin Walker, Tideswell (GB); Daniel Brendon Crowley, Gloucester (GB)

(73) Assignee: Smart Stabilizer Systems Centre, Ashchurch, Tewkesbury (GB)

( * ) Notice: Subject to any disclaimer, the term of this patent is extended or adjusted under 35 U.S.C. 154(b) by 248 days.

(21) Appl. No.: 12/480,104

(22) Filed: Jun. 8, 2009

(65) Prior Publication Data

US 2009/0308659 A1 Dec. 17, 2009

(30) Foreign Application Priority Data

Jun. 17, 2008 (GB) ..... 0811016.5

(51) Int. Cl.
*E21B 7/04* (2006.01)

(52) U.S. Cl. ..... 175/61; 175/74; 175/75

(58) Field of Classification Search ..... 175/61, 175/73, 74, 75, 76
See application file for complete search history.

(56) References Cited

U.S. PATENT DOCUMENTS

| | | | |
|---|---|---|---|
| 701,391 | A | 6/1902 | Pruszkowski |
| 3,260,318 | A | 7/1966 | Neilson et al. |
| 3,360,057 | A | 12/1967 | Anderson |
| 3,481,420 | A | 12/1969 | Roll |
| 3,713,500 | A | 1/1973 | Russell |
| 3,802,575 | A | 4/1974 | Ingram et al. |
| 3,841,420 | A | 10/1974 | Russell |
| 3,958,217 | A | 5/1976 | Spinnler |
| 4,401,134 | A | 8/1983 | Dailey |
| 4,465,147 | A | 8/1984 | Feenstra et al. |
| 4,480,066 | A | 10/1984 | Davis et al. |

(Continued)

FOREIGN PATENT DOCUMENTS

EP 0171259 A1 12/1986

(Continued)

OTHER PUBLICATIONS

International Search Report from UK patent application No. GB0909673.6 dated Sep. 18, 2009.

(Continued)

*Primary Examiner* — Giovanna Wright
*Assistant Examiner* — Richard Alker
(74) *Attorney, Agent, or Firm* — Wong, Cabello, Lutsch, Rutherford & Brucculeri, L.L.P.

(57) ABSTRACT

This invention relates to a steering component, to a steering assembly, and to a method of steering a drill bit in a borehole. The steering component is adapted for connection to a drill string, the drill string carrying a drill bit and a motor for rotating the drill bit. The steering component comprises: a rotatable driveshaft adapted for connection between the drill bit and the motor; a drive mechanism; and an offsetting component; the drive mechanism providing a rotatable connection between the drill string and the offsetting component whereby the drill string can rotate relative to the offsetting component. The drive mechanism is adapted to drive the offsetting component to rotate in an opposed direction to the driveshaft, so as to counter the rotation of the offsetting component which is induced by friction within the componentry as the driveshaft rotates. The steering component and method are likely to have their greatest utility in steering a drill bit during drilling for oil and gas.

16 Claims, 5 Drawing Sheets

U.S. PATENT DOCUMENTS

| | | | | |
|---|---|---|---|---|
| 4,485,879 | A | 12/1984 | Kamp et al. | |
| 4,492,276 | A | 1/1985 | Kamp | |
| 4,577,701 | A | 3/1986 | Dellinger et al. | |
| 4,637,479 | A | 1/1987 | Leising | |
| 4,742,498 | A | 5/1988 | Barron | |
| 4,763,258 | A | 8/1988 | Engelder | |
| 4,844,180 | A | 7/1989 | Zijsling | |
| 4,862,568 | A | 9/1989 | Wankmuller et al. | |
| 4,869,100 | A | 9/1989 | Birdwell | |
| 5,133,418 | A | 7/1992 | Gibson et al. | |
| 5,738,178 | A | 4/1998 | Williams et al. | |
| 6,053,261 | A | 4/2000 | Walter | |
| 6,092,610 | A | 7/2000 | Kosmala et al. | |
| 6,129,160 | A | 10/2000 | Williams et al. | |
| 6,233,524 | B1 | 5/2001 | Harrell et al. | |
| 7,086,486 | B2 | 8/2006 | Ravensbergen et al. | |
| 7,270,198 | B2 | 9/2007 | Camp | |
| 7,766,098 | B2 | 8/2010 | Farley | |
| 2002/0066598 | A1* | 6/2002 | Rozendaal et al. | 175/53 |
| 2002/0084109 | A1 | 7/2002 | Runquist et al. | |
| 2002/0166701 | A1 | 11/2002 | Comeau et al. | |
| 2003/0116355 | A1 | 6/2003 | Bar-Cohen et al. | |
| 2003/0146022 | A1 | 8/2003 | Krueger | |
| 2004/0236553 | A1 | 11/2004 | Chen et al. | |
| 2005/0194183 | A1 | 9/2005 | Gleitman et al. | |
| 2005/0236189 | A1* | 10/2005 | Rankin, III | 175/73 |
| 2008/0093124 | A1 | 4/2008 | Giroux et al. | |
| 2010/0263933 | A1 | 10/2010 | Farley | |
| 2011/0108327 | A1 | 5/2011 | Farley et al. | |

FOREIGN PATENT DOCUMENTS

| | | | |
|---|---|---|---|
| EP | 0333484 | A2 | 9/1989 |
| EP | 0467335 | A2 | 1/1992 |
| EP | 0624706 | A2 | 11/1994 |
| EP | 0798443 | A2 | 10/1997 |
| EP | 1024245 | A2 | 2/2000 |
| EP | 1258593 | A3 | 11/2002 |
| EP | 2202382 | A2 | 6/2010 |
| GB | 2352743 | A | 7/2001 |
| GB | 2435060 | A | 8/2007 |
| GB | 2440024 | A | 1/2008 |
| RU | 2114273 | C1 | 6/1998 |
| RU | 2233374 | C1 | 7/2004 |
| WO | 0166900 | A2 | 9/2001 |
| WO | 2005113928 | A2 | 12/2005 |
| WO | 2009032367 | A2 | 3/2009 |

OTHER PUBLICATIONS

Translated Office Action for corresponding Russian patent application No. 2009145914.

Non-Final Office Action for corresponding U.S. Appl. No. 12/344,873 mail date Sep. 7, 2010.

Non-Final Office Action corresponding U.S. Appl. No. 12/986,823 mail date Apr. 14, 2011.

International Search Report and Written Opinion from PCT/US2008/064642, dated Sep. 3, 2008 in corresponding U.S. Appl. No. 11/848,328.

Non-Final Office Action for related U.S. Appl. No. 11/848,328 mail date Jul. 31, 2009.

Final Office Action for related U.S. Appl. No. 11/848,328 mail date Jan. 27, 2010.

Notice of Allowance in related U.S. Appl. No. 11/848,328 mail date Apr. 7, 2010.

Non-Final Office Action for related U.S. Appl. No. 12/824,965 mail date Jul. 7, 2011.

Examiners First Report for corresponding Australian patent application No. 2009233655 mail date Jan. 6, 2011.

Non Final Office Action in related U.S. Appl. No. 12/986,823 mail date Apr. 14, 2011.

Translated Office Action for related Russian patent application No. 2010107703.

European Search Report dated Oct. 13, 2011 for referenced European patent application No. 09175318.6.

* cited by examiner

STEERING COMPONENT, STEERING ASSEMBLY AND METHOD OF STEERING A DRILL BIT IN A BOREHOLE

CROSS-REFERENCE TO RELATED APPLICATION

The present application claims priority from Great Britain Patent Application No. 0811016.5 filed on 17 Jun. 2008, the contents of which is incorporated herein by reference.

FIELD OF THE INVENTION

This invention relates to a steering component, to a steering assembly, and to a method of steering a drill bit in a borehole. The steering assembly comprises in particular a downhole motor and a steering component.

The steering component and method are likely to have their greatest utility in steering a drill bit during drilling for oil and gas, and the following description therefore refers primarily to such applications. The use of the steering component, assembly and method in other applications is not thereby excluded.

Such drilling applications utilise a drill bit which is rotatable about its longitudinal axis. The following description refers frequently to rotation, and unless otherwise indicated that term refers to rotation about a component's longitudinal axis. In the case of a rotating drill bit or a rotating drill string for example, the rotation occurs about the longitudinal axis of the component which axis typically corresponds closely to the centreline of the drilled borehole.

BACKGROUND TO THE INVENTION

When drilling for oil and gas it is desirable to be able to steer the drill bit, i.e. to move the drill bit in a chosen direction, so that the drill bit does not have to follow a path determined only by gravity and/or the drilling conditions.

One method of steering a drill bit is to use a downhole assembly with a bent housing, the bent housing resulting in the leading end of the drill bit being offset from the longitudinal axis of the majority of the drill string along the required toolface. The downhole assembly includes a downhole motor connected to the drill bit by way of a flexible driveshaft which rotates within the bent housing, the motor driving the drill bit to rotate whilst the remainder of the drill string, including the bent housing, does not rotate. One such downhole motor is a mud motor which uses the flow of drilling mud to drive the drill bit. The bent housing allows the drill bit to follow a non-linear or curved path, the drill bit moving in the direction of the offset.

Often, this method and apparatus will be utilised when the desired direction and degree of curvature of the borehole is known. However, to cater for unexpected drilling conditions an operator will usually design the housing with a greater bend than necessary, so that the desired degree of curvature can be achieved even if the drilling conditions result in the drill bit deviating from a linear path less than was expected. If, however, the drill bit does deviate as much as expected, this will result in the curvature of the borehole exceeding that desired, so that a linear (or more linear) length of borehole needs to be drilled to compensate. The linear (or more linear) length of borehole is drilled by rotating the whole of the drillstring, which rotates the bent housing and thereby continuously changes the direction of the offset of the drill bit and cancels out the tendency to curve in one direction.

Accordingly, the use of such a method requires the drill string to be non-rotating whilst a curved borehole is being drilled. It is widely recognised that a non-rotating drill string experiences greater friction upon the borehole wall than a rotating drill string, i.e. the resistance to drill bit advance will comprise the resistance of the rock through which the drill bit is moving, plus the resistance to movement of the drill string along the borehole. A drill string which is rotating experiences less resistance to movement along the borehole and therefore enables the drilling of deeper boreholes. Very deep boreholes are commonly required to reach the remaining reserves of oil and gas, and those reserves cannot all be reached with a non-rotating drill string.

In addition, a rotating drill string is less likely to buckle under the applied axial load than a non-rotating drill string. Furthermore, borehole cleaning is improved with a rotating drill string, i.e. drill cuttings in the drilling fluid returning to the surface are less likely to sink and settle at the low side of a (non-vertical) borehole.

A steering assembly and component is described in U.S. Pat. No. 7,270,198. This document describes a downhole assembly having a downhole motor connected to a drill bit by way of a flexible drill shaft which can rotate within a bent housing. A clutch mechanism is located between the drill shaft and the bent housing, the clutch mechanism being able to drive the bent housing to rotate so as to change the toolface offset and permit the drilling of a linear (or more linear) borehole. A set of spur gears is provided between the clutch mechanism and the bent housing, which gears are stated to reduce the rate of rotation of the bent housing relative to the rate of rotation of the drill shaft. This document utilises a non-rotating drill string in the form of a continuous pipe, and therefore shares the disadvantages of the other known non-rotating drill string methods described above, so that the described assembly and component are only useful for relatively short-length boreholes such as those provided for the underground utilities to which the document is directed.

British patent applications 2 435 060 and 2 440 024 each disclose a steering assembly for a drill bit, the downhole assembly comprising a mud motor connected to the drill string, a bent housing connected to the mud motor and a drill bit connected to the bent housing. The mud motor is connected to the drill string by way of a slipping clutch mechanism, the torque which is transmitted by the clutch being variable so as to match the counter-rotation torque experienced by the mud motor as the drill bit rotates. The slipping clutch mechanism must be designed to withstand the considerable torque which can be imparted by the mud motor, a typical drilling torque for a 9.625 inch mud motor being 20,000 lbf. ft, (and a maximum torque being around 32,000 lbf. ft.). In addition, the slipping clutch mechanism must be able to react to rapid and significant changes in the instantaneous torque as the drilling conditions change. The apparatus of these patents is therefore highly complex and expensive.

Other steering apparatuses and methods are known, for example the steering component described in our published European patent application EP-A-1 024 245. That steering component allows the drill bit to be moved in any chosen direction, i.e. the direction (and degree) of curvature of the borehole can be determined during the drilling operation, and as a result of the measured drilling conditions at a particular borehole depth. That steering component, as with the steering assemblies of the two identified British patent applications, can be used with a rotating drill string and therefore avoids the disadvantages of the first cited document. Despite the advantages of these steering components and assemblies, however, operators require a less complex steering component and assembly for many applications.

SUMMARY OF THE INVENTION

The inventors have therefore sought to develop a steering assembly and steering component which is less complex than that of EP-A-1 024 245, and yet which offers many of the advantages of such a steering component. The inventors have sought to make the steering assembly and component suitable for use with a rotating drill string so that it can be used when drilling deeper boreholes than can be achieved with a non-rotating drill string. The inventors have also sought to develop a steering assembly which can be used with a downhole motor and yet does not need to withstand the full torque of the motor, so that it is less complex and therefore less expensive to manufacture.

According to the invention therefore, there is provided a steering component comprising:

a driveshaft adapted for connection between a drill bit and a downhole motor, a drive mechanism, and an offsetting component, the drive mechanism being adapted for connection between the drill string and the offsetting component, the drive mechanism providing a rotatable connection between the drill string and the offsetting component whereby the drill string can rotate relative to the offsetting component, the drive mechanism being able to drive the offsetting component to rotate in an opposed direction to the driveshaft.

The rotatable connection of the drive mechanism enables the drill string to rotate relative to the offsetting component. The offset toolface is controlled by the angular orientation of the offsetting component, and the ability of the drill string to rotate relative to the offsetting component allows the steering component to be used with a rotating drill string.

The rotatable connection is not without friction, however, and it is therefore expected that in all practical applications the offsetting component will tend to rotate with the drill string (if the drill string is rotating) and/or with the rotating driveshaft. The downhole assembly carries a sensor adapted to determine the angular orientation (azimuth) of the offsetting component. The sensor may be a part of the steering component itself, or it may be a part of a separate downhole tool package. The drive mechanism counters the induced rotation of the offsetting component in order to maintain a substantially constant toolface for the offset.

Because the steering component is not located between the downhole motor and the drill string it is not required to withstand the counter-rotation torque imparted by the motor. As the drive mechanism of the steering component is located between the drill string and the offsetting component the drive mechanism is only required to withstand the (much lower) frictional torque imparted to the offsetting component. Alternatively stated, the steering component is configured to surround a part of the driveshaft connected to the rotor of the downhole motor but it does not experience any of the bit torque transmitted by the driveshaft.

Desirably, the downhole motor is a mud motor. Preferably the drill string and the driveshaft rotate in the same direction. It will be understood that there are many different types of downhole motor, all of which are designed to impart rotation into an (output) driveshaft, and the present invention can be used with any of these motors. In a mud motor in particular, drilling fluid or mud is pumped down the drill string and as the mud passes through the stator of the motor it engages a rotor and causes the rotor (and the driveshaft connected thereto) to rotate in a chosen direction. The rate of rotation of the rotor is directly dependent upon the rate of flow of the mud. Since the stator is typically connected to the drill string it is desirable to rotate the drill string in the same direction as the driveshaft so that the rate of rotation of the driveshaft relative to the borehole wall (and therefore the rate of rotation of the drill bit) is increased by the rotation of the drill string.

In such embodiments therefore, the rotating driveshaft and the rotating drill string will both induce the offsetting component to rotate in a particular direction, this induced rotation being detected by the sensor and being opposed (corrected) by the drive mechanism.

Preferably, the offsetting component has at least one borehole-engaging element adapted to engage the wall of a drilled borehole. Typically each borehole-engaging element will be the blade of a stabilier. The offsetting component may for example be a near-bit stabilizer located between the drill bit and the drive mechanism. The offsetting component will preferably accommodate the driveshaft, with the driveshaft being eccentric to the borehole-engaging element(s). The eccentric location of the driveshaft will cause the drill bit to deviate from the longitudinal axis of the drill string, and the angular orientation of the offsetting component will determine the angular orientation of the eccentricity and therefore the direction of curvature of the drilled borehole.

The borehole-engaging elements act as a brake upon the induced rotation of the offsetting component. It is not usual in a practical embodiment that a borehole-engaging element could prevent any induced rotation, but it is expected that such an element will reduce the actions required of the drive mechanism, i.e. the offsetting component when connected to a borehole-engaging component will rotate far more slowly than either the driveshaft or the drill string.

Preferably, the drive mechanism is a gearbox and clutch mechanism; preferably also the gearbox provides the rotatable connection. In such an arrangement the clutch mechanism can be selectively actuated to control the opposed (correcting) rotation of the offsetting component. Preferably, the clutch mechanism has an engaged condition in which the drive mechanism causes opposed rotation of the offsetting component, and a disengaged condition in which the drive mechanism is inactive and the offsetting component experiences only induced rotation.

Clearly, it is necessary that the drive mechanism can overcome the friction causing the induced rotation. This friction can be determined empirically or experimentally and it is likely that the drive mechanism will not need to provide a very large torque to cause the offsetting component to rotate in the opposed direction to the induced rotation.

Preferably, the drive mechanism operates cyclically. It will be understood that such cyclical operation will not maintain the toolface with a constant offset. However, provided the cycles are sufficiently frequent the variation in the offset will not be significant.

Ideally, the drive mechanism comprises a sun and planet gearset and a clutch mechanism, the sun and planet gearset comprising a sun gear, at least one planet gear rotatably mounted upon a planet carrier, and a ring gear. Preferably, the sun gear is connected to the driveshaft by way of the clutch mechanism, the planet carrier is connected to the drill string, and the ring gear is connected to the offsetting component. It will be understood that when the clutch mechanism is disengaged and the sun gear can rotate freely, rotation of the planet carrier (driven by the drill string) will be accompanied by rotation of the planet gear(s) about their respective axes, which will drive the sun gear to rotate whilst the ring gear can remain substantially stationary. The sun and planet gearset therefore provide the rotatable connection between a rotating drill string and a substantially stationary offsetting component.

In practice, however, the clutch when disengaged will not be frictionless, and together with the friction of the rotating planet gears the ring gear will typically experience a torque causing an induced rotation, and thereby an induced rotation in the offsetting component. Friction within the bearings and seals of the steering component will also contribute towards the induced rotation.

When the clutch is engaged the sun gear rotates with the driveshaft. As above indicated the rate of rotation of the driveshaft driven by the downhole motor will exceed the rate of rotation of the drill string, so that the rate of rotation of the sun gear will exceed that of the planet carrier. The planet carrier can therefore be considered as a "stator" even if it is not actually stationary and the rotation of the sun gear will cause rotation in the ring gear in the opposed direction to that of the sun gear. The rate of opposed rotation of the ring gear, and therefore the rate of opposed rotation of the offsetting component, will be determined by the relative rates of rotation of the planet carrier and the sun gear (which will be determined directly by the downhole motor), and the ratio of gear teeth in the sun gear and ring gear.

It will therefore be understood that when the clutch mechanism is disengaged the offsetting component undergoes induced rotation in the same direction as the drill shaft and drill string, and that when the clutch mechanism is engaged the offsetting component undergoes forced rotation in the opposed direction. The clutch mechanism can cycle between periods of engagement and disengagement, permitting the offsetting component to oscillate around a desired toolface offset. The shorter the cycle of the clutch mechanism the smaller the oscillations of the offsetting component, but the greater the degree of azimuthal sensing and control required.

By choosing a downhole motor to provide a suitable relative rate of rotation between the sun gear and planet carrier, and by choosing suitable gear ratios, it can be determined that the steering component operates anywhere in a range between high speed (i.e. the opposed rotation is very much faster than the induced rotation so that the clutch mechanism should be engaged for very short periods of time in each cycle), or low speed (i.e. the opposed rotation is much slower relative to the induced rotation so that the clutch mechanism should be engaged for longer periods in each cycle). In all cases, however, it must be arranged that the gear ratios are chosen to ensure that there will be opposed rotation, i.e. the rate of rotation of the ring gear exceeds the rate of rotation of the drill string and planet carrier.

In one particular embodiment the clutch mechanism can be arranged to slip continuously, the engagement of the clutch being sufficient to hold the offsetting component in a substantially fixed position, i.e. with the rotational force provided by the drive mechanism being substantially continuously matched to the frictional forces inducing rotation.

The offsetting component can take many forms. In its simplest form it is a bent housing comprising a sleeve surrounding the driveshaft, the driveshaft being sufficiently flexible to conform to the bend in the sleeve during its rotation. Alternatively, the offsetting component can be a collar through which the driveshaft passes, the collar being eccentric to the borehole so that the driveshaft is held away from the centre of the borehole. Preferably, however, as above stated the offsetting component is a near-bit stabilizer or pivot stabilizer having borehole-engaging elements which are eccentric to the driveshaft.

In some embodiments, the offsetting component can provide a variable offset, the minimum offset being substantially zero. When the offset is adjusted to be substantially zero the drill bit will drill a substantially linear borehole (subject to gravity and downhole conditions) regardless of the orientation of the offsetting component. When it is desired to drill a curved borehole the offset is increased and the drive mechanism is activated to control the angular orientation of the offset. It is expected that an offsetting component which can provide a substantially zero offset would result in a more linear borehole than could be achieved with a downhole assembly having a constant offset, notwithstanding that the latter assembly could be used to drill a substantially linear borehole by constantly varying the toolface of the offset.

As above indicated it is expected that in practical applications friction within the steering component will induce rotation of the offsetting component. However, it may sometimes occur that the induced rotation is prevented, or occurs more slowly than desired, and to cater for that it is desirable to be able to drive the offsetting component also in the direction of rotation of the driveshaft. Alternatively therefore, the stated drive mechanism is a first drive mechanism and there is also a second drive mechanism which is able to drive the offsetting component to rotate in the same direction as the driveshaft.

There is also provided a steering assembly for connection to a rotating drill string, comprising a steering component as herein defined, a downhole motor and a drill bit, the steering component being located between the downhole motor and the drill bit.

BRIEF DESCRIPTION OF THE DRAWINGS

The invention will be described, by way of example, with reference to the accompanying highly schematic drawings, which show.

DESCRIPTION OF THE PREFERRED EMBODIMENTS

Figure 1:
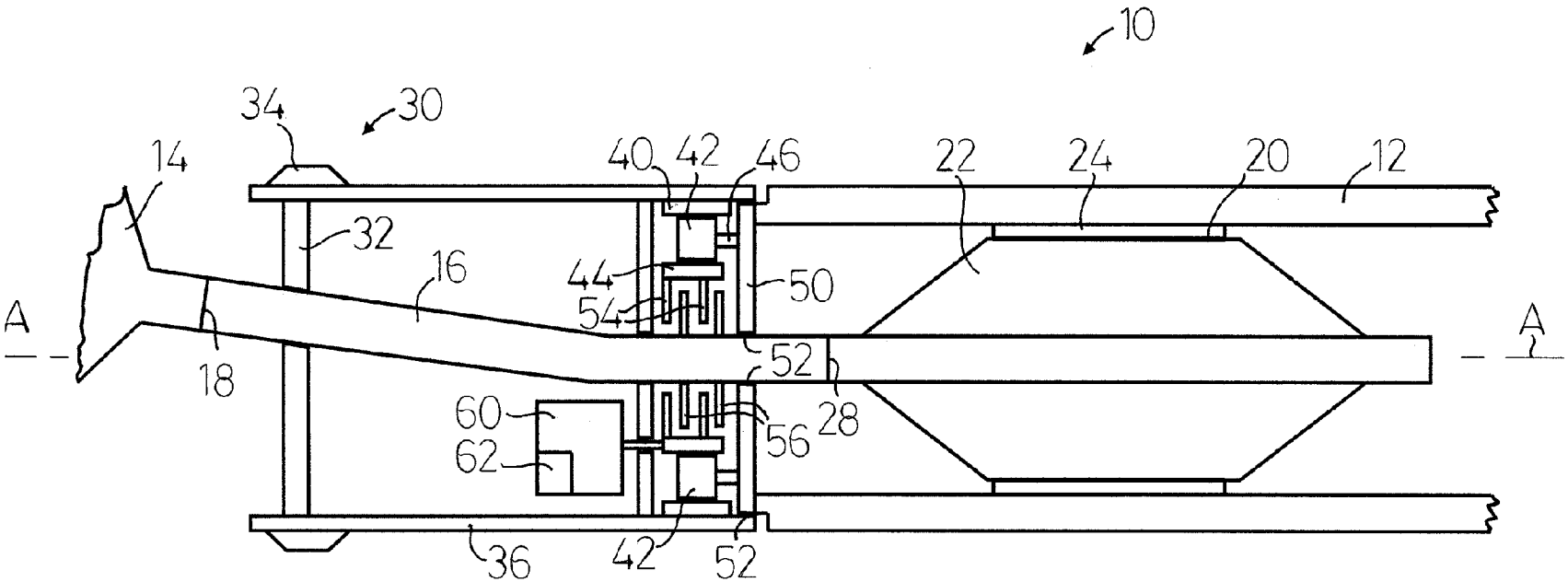
FIG. 1 a side sectional view of a downhole assembly incorporating a first embodiment of steering component according to the present invention.

Only those parts of the downhole assembly which are relevant to the present invention are shown and described in relation to the drawings, the other components which will typically form a part of the downhole assembly are omitted for ease of understanding.

The steering component 10 is connected to a drill string 12, and also to a drill bit 14. The drill bit 14 is mounted upon a driveshaft 16, by way of a threaded connection 18, in known fashion The driveshaft 16 is also connected, by way of another threaded connection 28, to the rotor of a downhole motor 20. In this embodiment the downhole motor is a mud motor.

The mud motor 20 is shown schematically, since the detailed design of the mud motor is not relevant to the present invention, and the invention could be effected using any one of many different designs of downhole motor.

One form of mud motor utilises a rotor 22 in the form of a helix, which can rotate inside a sleeve 24 formed as a corresponding helical chamber of substantially the same length. The sleeve has a helix with a chosen number of lobes and the rotor has a helix with a number of lobes, the number of lobes of the sleeve being one more than the number of lobes of the rotor. The sleeve and rotor are configured to define a discrete series of encapsulated volumes between the rotor and the sleeve. As drilling fluid is pumped through the drill string it causes the rotor to rotate so that the fluid within the encapsulated volumes passes from "above" the rotor to "below" the rotor.

In another embodiment the mud motor comprises a turbine with a number of rotor blades which are driven to rotate by the passage of mud.

In yet other embodiments the downhole motor is electrically-powered, either by way of electricity conducted from the surface, or generated downhole.

It is arranged that the orientation of the rotor helix 22 causes the driveshaft 16 to rotate in the same direction as the drill string 12, so that the rate of rotation of the driveshaft 16 is greater than (and in a typical application far greater than) the rate of rotation of the drill string 12.

Though not shown in FIG. 1, at least part of the driveshaft 16 will typically be hollow, and after passing the mud motor 20 the drilling fluid enters the driveshaft 16 and passes therealong to exit adjacent to the drill bit 14. Drill cuttings are carried to the surface by the drilling fluid which flows along the outside of the drill string, in known fashion.

Adjacent to the drill bit 14 is an offsetting component, in this embodiment in the form of a near-bit stabilizer 30. The near-bit stabilizer 30 has a collar 32 which mounts bearings (not shown) for engagement with the driveshaft 16. The near-bit stabilizer also has a set of blades 34 for engaging the borehole wall (not shown).

The stabilizer 30 causes the driveshaft 16 to deviate from the longitudinal axis A-A of the drill string 12. In this embodiment the deviation is caused by the eccentricity of the collar 32, but in other embodiments the deviation or eccentricity can be caused by different-sized blades (34) around the stabilizer, for example.

By causing the driveshaft 16 to deviate from the longitudinal axis A-A of the drill string 12, the stabilizer provides an offset toolface and causes the drill bit 14 to drill a non-linear borehole.

It will be understood that the degree of eccentricity of the collar 32 shown in FIG. 1 (and similarly in the other figures) is highly exaggerated for the purpose of clarity. In practice the degree of eccentricity is relatively small, and in particular small enough to allow the metallic driveshaft 16 to conform to its forced deviation as it rotates within the collar 32.

It will also be understood that a further stabilizer may be located between the stabilizer 30 and the drill bit 14 if desired, the further stabilizer acting as a fulcrum for the driveshaft 16.

The stabilizer 30 does not rotate with the drill string 12, i.e. it is intended that the angular orientation (or azimuth) of the stabilizer 30 be maintained substantially constant. Whilst that is the case the drill bit 14 will drill a non-linear borehole, with a degree of curvature dependent upon the geometry of the steering assembly. The direction of curvature can be controlled by the angular orientation of the stabilizer 30.

The stabilizer 30 is directly connected by way of a sleeve 36 to a ring gear 40 which has gear teeth (not shown) which engage the teeth (also not shown) of respective planet gears 42. In this embodiment there are four planet gears 42, though only two are seen in the sectional representation of FIG. 1. The teeth of the planet gears in turn engage the teeth (not shown) of a sun gear 44.

It will be understood from the following description that the sun and planet gearsets could operate with only one planet gear, but it is preferred to have a balanced arrangement of planet gears around the driveshaft, and three or four planet gears are therefore desirable.

The planet gears 42 are each mounted upon a respective axle 46, the axles 46 all being connected to a planet carrier 50. The planet carrier 50 is in turn connected to the drill string 12. In this embodiment the planet carrier 50 is separated from the driveshaft 16 and from the sleeve 36 by way of respective sliding seals 52. The planet carrier 50 therefore serves the additional purpose of preventing drilling fluid engaging the gears 40, 42 and 44, allowing the gears to be immersed in a suitable lubricating fluid.

The sun gear 44 is annular and on its inner wall it has a set of annular clutch plates 54, which are selectively engageable with a corresponding set of annular clutch plates 56 mounted upon the driveshaft 16. Whilst in this embodiment the sun gear 44 surrounds the clutch plates 54, 56, in other embodiments (see for example FIG. 4) the sun gear lies alongside the clutch plates (the latter embodiments permitting the sun gear to have a smaller outside diameter and fewer gear teeth). A control means 60 is provided which can drive the sun gear towards the right as drawn, forcing the clutch plates 54, 56 into engagement, and consequently causing the sun gear 44 to rotate with the driveshaft 16.

As shown in FIG. 1 the clutch mechanism 54, 56 is disengaged, so that the sun gear 44 can rotate independently of the driveshaft 16. It is preferred that the clutch mechanism is biased to its disengaged condition, suitably by a return spring or the like.

When the drill string 12 rotates the planet carrier 50 is driven to rotate. The ring gear 40 is held substantially stationary by way of the blades 34 engaging the borehole, so that rotation of the planet carrier 50 causes the planet gears to rotate about their own axles 46 and to drive the (free) sun gear 44 to rotate. It will be understood, however, that the sliding seals 52 of the planet carrier, the fluid between the clutch plates 54 and 56, and the engagement between the respective gears, causes an induced rotation of the ring gear 40. Also, the bearings and seals between the driveshaft 16 and the collar 32, and between the collar 32 and the sleeve 36, cause an induced rotation in the sleeve 36. Because the blades 34 of the stabiliser 30 engage the wall of the borehole they will act as a brake upon the induced rotation, so that the induced rotation will be relatively slow compared to the rate of rotation of the drill string 12 and the driveshaft 16.

In this embodiment the control means 60 includes a sensor 62, the sensor being adapted to determine the angular orientation (azimuth) of the stabilizer 30. The sensor 62 can detect the induced rotation of the stabilizer 30, and the control means can be configured to engage the clutch mechanism 54, 56 when the angular orientation of the stabilizer reaches a predetermined limit compared to the desired anguler orientation.

Figure 2:
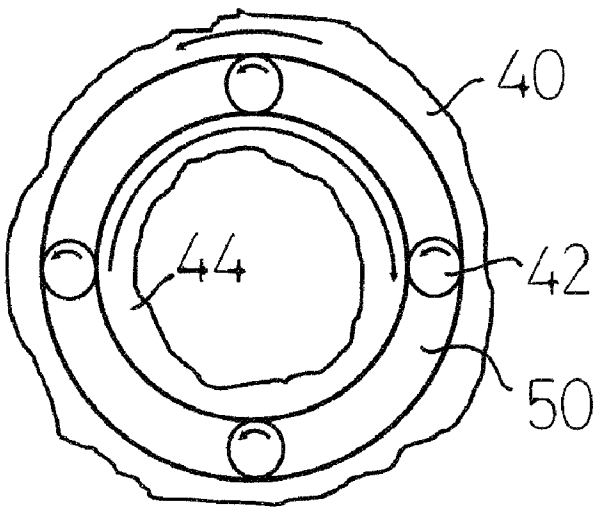
FIG. 2 a front view of the sun and planet gear arrangement of the steering component of FIG. 1.

When the clutch plates 54 and 56 are engaged, the sun gear 44 is caused to rotate with the driveshaft 16. As indicated above, the driveshaft 16 will rotate at a much greater rate than the drill string 12 and planet carrier 50, and this results in the sun gear rotating at a much greater rate than the planet carrier. When the sun gear 44 rotates faster than the planet carrier, i.e. faster than the axles 46 of each of the planet gears 42, the planet gears 42 rotate in the opposite direction as shown, and consequently drive the ring gear 40 to rotate in the opposite direction to the sun gear 44 and driveshaft 16. The ring gear 40 rotates at a slower angular rate than the sun gear 44, as represented by the length of the respective arrows in FIG. 2, because of the rotation of the planet carrier 50. Accordingly, engagement of the clutch mechanism 54, 56 causes the stabilizer 30 to be driven to rotate back to its desired angular orientation.

Because the rate of opposed rotation will be determined by the configuration of the components in the drive mechanism, the control means 60 can cause the clutch mechanism 54, 56 to engage for a predetermined period of time corresponding to a desired angular correction, or the angular correction can be measured by the sensor 62.

It will be understood that the control means 60 will cause the clutch mechanism 54, 56 to engage cyclically, and ideally will cause the stabilizer 30 to oscillate through a chosen number of degrees. It is arranged that the opposing rotation drives the stabilizer past its desired azimuth so that the oscillations of the stabilizer 30 are centred on the desired azimuth. The amplitude of the oscillations can be determined according to the application, with a smaller amplitude providing a borehole closer to the desired curvature, but requiring more frequent cycles of the clutch mechanism and greater sensitivity of the sensor 62.

It is expected that the rate of opposed rotation will be considerably greater than the rate of induced rotation, and so it is expected that the clutch mechanism will be disengaged for considerably more than half of each of its cycles, but as above indicated the rate of opposed rotation can be determined by a choice of the componentry.

When it is desired to drill a linear (or more linear) borehole, the clutch mechanism can be engaged permanently, causing the stabilizer 30 to be driven to rotate at a known rate, or (less preferably) the clutch mechanism can be disengaged permanently, permitting the induced rotation of the stabilizer 30 to cancel out the tendency of the drill bit to curve the borehole in one direction.

Figure 3:
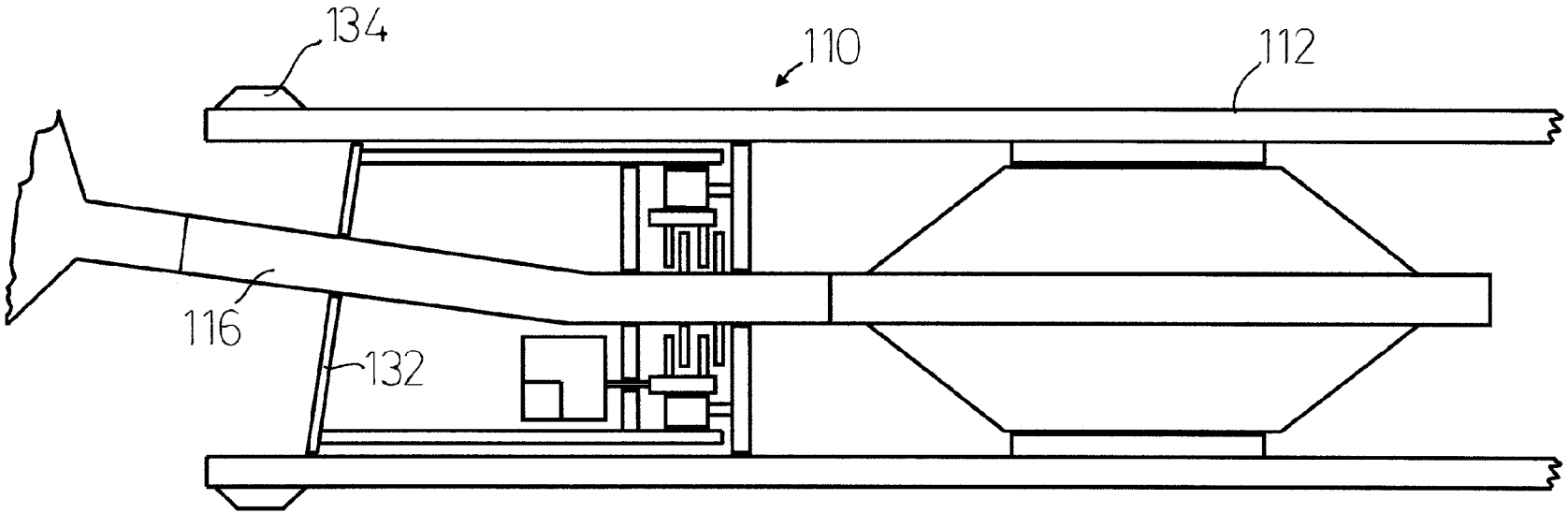
FIG. 3 a side sectional view of a downhole assembly incorporating a second embodiment of steering component.

The embodiment of FIG. 3 differs from that of FIG. 1 in that the steering component 110 is located within an annular housing 112 comprising a continuation of the drill string. The end of the housing 112 carries borehole-engaging blades 134 and also an eccentric collar 132.

The major advantage of the embodiment of FIG. 3 is that the steering component 110 is not required to rotate the borehole-engaging elements 134. Instead, it is required to rotate the eccentric collar 132 which comprises a plate or the like mounted on suitable sealing bearings within the housing 112, having an opening (surrounded by suitable sealing bearings) though which the driveshaft 116 passes. The torque which will be required to rotate the collar 132 will likely be far lower than that required to rotate the stabilizer 30 of FIG. 1.

It will be noted that the plate 132 is angled perpendicularly to the driveshaft 116. Whether the manufacturer chooses to angle this plate or not will determine the suitable type and orientation of the bearings and seals which should be used to mount the eccentric component, for all of the embodiments of the invention.

Figure 4:
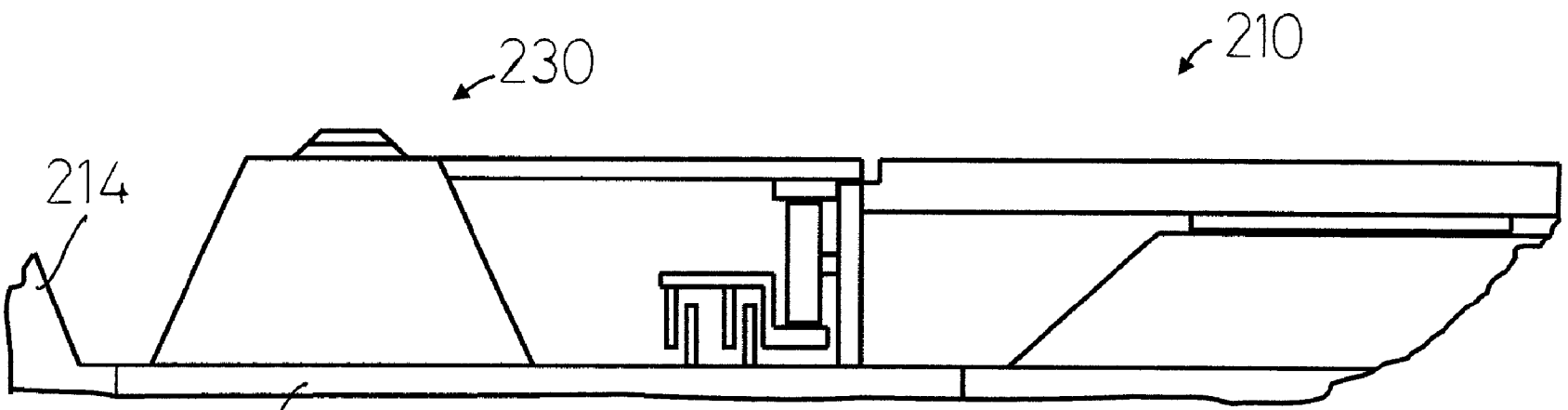
FIG. 4 a side sectional view of part of a downhole assembly incorporating a third embodiment of steering component.

In the embodiment of FIG. 4 the steering component 210 has an offsetting component with a variable offset, the offsetting component in this embodiment being a near-bit stabilizer 230. As is more clearly shown in FIG. 5, the stabiliser 230 has three housings 70, each of which mounts a respective blade 234. One of the blades 234*a* is controllable, in that a control means (not shown) can be operated to vary the distance by which the blade 234*a* projects from its housing 70. The other two blades 234*b* are spring biased to project out of their respective housings 70.

Figure 5:
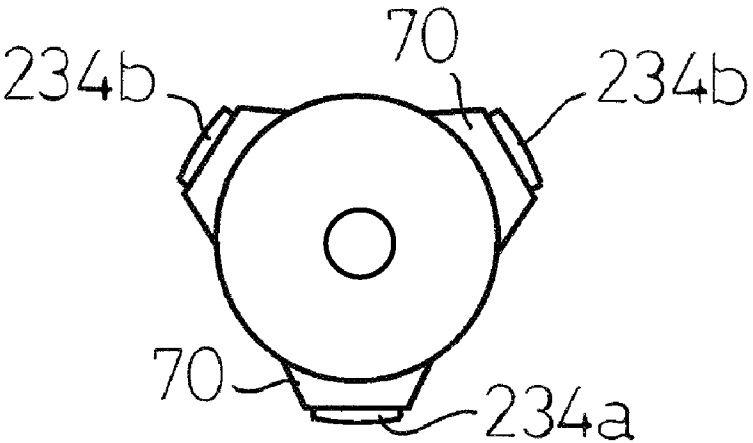
FIG. 5 a cross-sectional view of the offsetting component of FIG. 4.

In the position shown in FIG. 5 the controllable blade 234*a* is set to a position corresponding to zero offset (zero eccentricity), so that the three blades 234 project from their respective housings by substantially the same distance. In this position, the drill bit 214 will be caused to drill a substantially linear section of borehole (subject to gravity and downhole conditions) regardless of the orientation of the stabiliser 230.

When it is desired to drill a curved section of borehole the controllable stabiliser 234*a* is caused to project by a greater distance (or in less preferred embodiments by a lesser distance) from its housing 70. The blades 234*b* are pressed back into their respective housings 70, against their spring bias. The drill shaft 216 is thereby caused to deviate from the longitudinal axis of the drill string. The gearbox of the steering component 210 is operated to maintain the angular orientation of the stabiliser 230 within a predetermined range.

It will be understood that the embodiments of FIGS. 1-5 provide a drive mechanism which can drive the offsetting component to rotate in the direction opposed to the rotation of the drill string, whereby to counter the induced rotation of the offsetting component caused by friction within the seals and other componentry. It may happen, however, that in a particular application the induced rotation cannot achieve the desired offset for the toolface. For example, in a particular borehole the resistance to rotation in the direction of rotation of the driveshaft may equal the force of induced rotation, or may be so close to the force of induced rotation that the rate of induced rotation is unacceptably slow. In those circumstances the operator has the option to engage the clutch mechanism and drive the offsetting component in the opposed direction to achieve the desired toolface offset, but that may require driving the offsetting component almost a complete revolution which may not be desired. Some operators may therefore prefer a steering component which does not rely (only) upon induced rotation in the direction of rotation of the driveshaft, but has means to positively drive the offsetting component in that direction also. Such a steering component is shown in FIG. 6.

Figure 6:
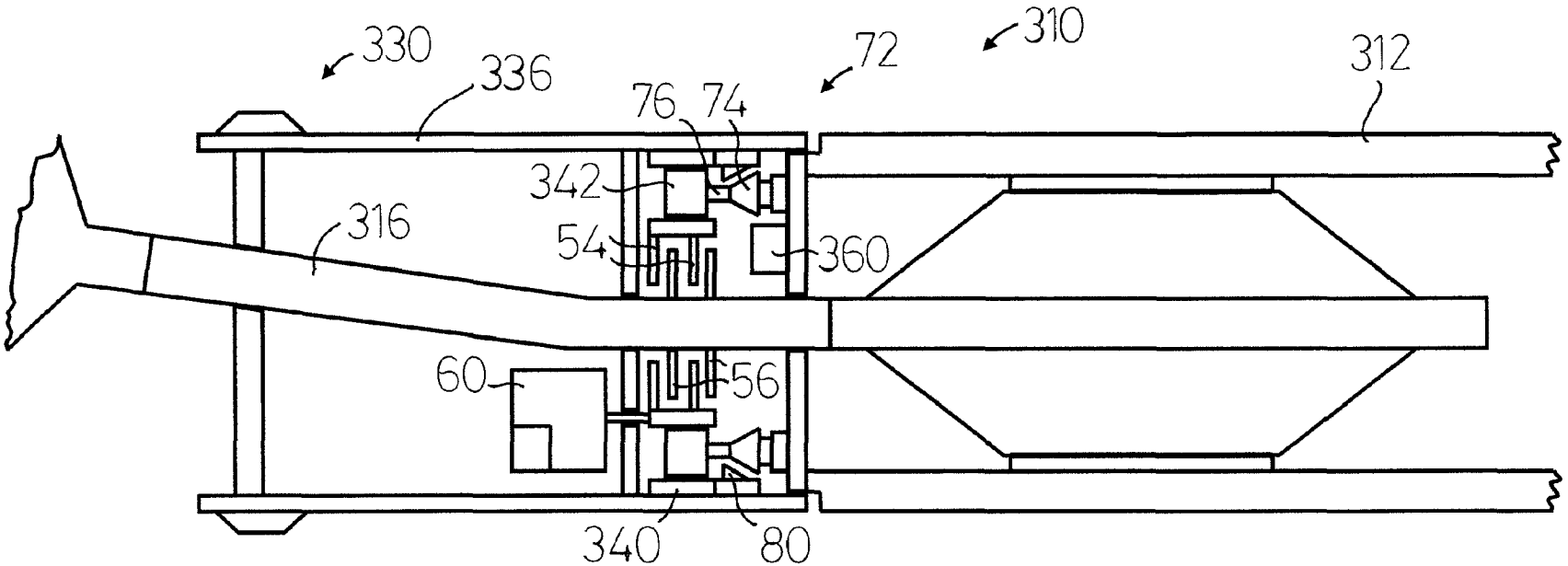
FIG. 6 a cross-sectional view of a downhole assembly incorporating a fourth embodiment of steering component.

The steering component of FIG. 6 has a second drive mechanism 72 located between the drill string 312 and the offsetting component 330. In this embodiment the second drive mechanism 72 comprises a cone clutch 74 slidably mounted upon the axle 76 of a planet gear 342. The cone clutch can be driven along the axle 76 to engage a correspondingly-shaped annulus 80 located adjacent to the ring gear 340. It will be understood that when the cone clutch 74 engages the annulus 80 the ring gear 340 and thereby the sleeve 336 and offsetting component 330 are driven to rotate in the same direction as the drill string 312.

The embodiment of FIG. 6 is therefore similar to the earlier embodiments in utilising the relative rotation between the driveshaft and the drill string to provide rotation in a direction opposed to the direction of rotation of the driveshaft. This embodiment furthermore takes advantage of the fact that the drillstring is rotating in the same direction as the driveshaft in order to provide driven rotation in the direction of rotation of the driveshaft.

It will be noted that both of the planet gear axles 76 seen in FIG. 6 carry a cone clutch 74; whilst only a single clutch mechanism is required it is desirable to provide a balanced force around the driveshaft, so that mounting a cone clutch on each of the axles is preferred.

In this embodiment a second control means 360 is provided to control the position of the cone clutches 74, but it will be understood that the position of the cone clutches could alternatively be controlled by the control means 60. An advantage of using the same control means for both of the drive mechanisms is that the first and second drive mechanisms should not be used at the same time, and a single control means can ensure that either the first drive mechanism, or the second drive mechanism, is operating at a given time.

In embodiments such as that of FIG. 6 in which the drive mechanisms comprise respective clutch mechanisms, if the clutch mechanisms are hydraulically actuated the single control means can include a two-way valve which can direct hydraulic fluid either to the first drive mechanism controlling the clutch plates 54, 56, or to the second drive mechanism 72 controlling the cone clutches 74.

Even in embodiments having a second drive mechanism, however, it is likely that the second drive mechanism will not be used continuously, and that the steering component 310 will rely at least partly upon the induced rotation. In practice for example the second drive mechanism could be utilised to control the angular position of the offsetting component during initial orientation of the offset of the toolface, and during re-orientation for example after the drill bit has been lifted from the bottom of the borehole (lifting of the drill bit being known to cause significant uncontrolled rotation of the downhole assembly). Once the offset of the toolface has been established, however, it is expected that the steering component 310 will undergo cycles of operation of the first drive mechanism and would only employ the second drive mechanism if exceptional circumstances result in cessation of the induced rotation. These latter embodiments could utilise a three-way valve in a hydraulic control means, able to send hydraulic fluid to engage the clutch plates 54, 56, or to engage the cone clutches 74, or to disengage both clutch mechanisms.

Whilst FIG. 6 shows a first drive mechanism substantially identical to the first embodiment of FIG. 1, it will be understood that the second and third embodiments could utilise a second drive mechanism for the same purpose also.

In addition, it will be understood that the second drive mechanism could utilise rotation of the driveshaft rather than rotation of the drill string in order to drive the offsetting component, i.e. a clutch mechanism could be located between the driveshaft 316 and the sleeve 336, for example. This would be necessary in embodiments in which the drill string is non-rotating, but is less preferable in embodiments in which the drill string is rotating since it is expected to be easier to exploit the slower rotation of the drill string.

Whilst the second drive mechanism of FIG. 6 utilises cone clutches 74 and the first drive mechanism utilises a set of clutch plates 54, 56, it will be understood that these clutch mechanisms are interchangeable, and are merely two of the many available types of clutch mechanisms which could be utilised in the drive mechanism(s) of each of the embodiments. The clutch mechanisms do not need to be mechanical, and could for example be electromagnetic.

Preferably, all of the clutch mechanisms used in the respective embodiments are biased, and most suitably resiliently biased, into their disengaged condition, so that the control means 60, 360 is required to drive the clutch mechanisms into engagement, with the clutch mechanisms becoming automatically disengaged.

For ease of understanding the drawings show the stator of the mud motor connected directly to the drill string, but it will be understood that in practice the downhole motor would typically be provided as a separate component which could be connected (usually by a threaded connection) to the drill string. Similarly, whilst the planet carrier is shown as a continuation of the drill string, in practical applications the planet carrier would typically be indirectly connected to the drill string by way of a connection (typically a threaded connection) to the housing of the downhole motor. Furthermore, whilst it would be possible to provide the steering component and the stabilizer as a single component similar to that as drawn in FIGS. 1 and 4, in practice it would likely be preferable to provide these as separate components which would be connected together prior to insertion into the borehole.

It will be understood that alternative embodiments could be provided in which the first drive mechanism is mounted between the ring gear and the stabilizer, for example.

Whilst the invention has been described in relation to a rotating drill string, it will be understood that it could be utilised also with a non-rotating drill string if desired. Also, it is not necessary for the invention that the drill string and driveshaft rotate in the same direction, but there are few if any applications where it would be advantageous not to share this feature.

The invention is not limited to drilling applications, and could for example be used to control the angular orientation of any suitable component within a remote location, including for example the sensor package of a formation logging tool.

The invention claimed is:

1. A steering component adapted for connection to a drill string, the drill string carrying a drill bit and a motor for rotating the drill bit relative to the drill string, the steering component comprising:

a rotatable driveshaft adapted for connection between the drill bit and the motor;

a first drive mechanism; and an offsetting component;

the first drive mechanism providing a rotatable connection between the drill string and the offsetting component whereby the drill string can rotate relative to the offsetting component, the first drive mechanism utilizing relative rotation between the driveshaft and drill string to drive the offsetting component to rotate in an opposed direction to the driveshaft, wherein the steering component further comprises a second drive mechanism adapted to drive the offsetting component to rotate in the same direction as the driveshaft.

2. A steering component according to claim 1 wherein the first drive mechanism operates cyclically, and drives the offsetting component to rotate in the opposed direction during only part of each cycle.

3. A steering component according to claim 1 wherein the offsetting component has at least one borehole-engaging element adapted to engage the wall of a drilled borehole.

4. A steering component according to claim 3 wherein the offsetting component locates a part of the driveshaft, with the driveshaft being eccentric to the borehole-engaging element (s).

5. A steering component according to claim 4 wherein the offsetting component is a stabilizer.

6. A steering component according to claim 1 wherein the first drive mechanism comprises a gearbox and clutch mechanism.

7. A steering component according to claim 6 wherein the gearbox provides the rotatable connection.

8. A steering component according to claim 6 wherein the clutch mechanism has an engaged condition and a disengaged condition, and wherein the drive mechanism drives the offsetting component to rotate in the opposed direction to the driveshaft when the clutch mechanism is in its engaged condition.

9. A steering component according to claim 1 wherein the first drive mechanism comprises a sun and planet gearset and a clutch mechanism, the sun and planet gearset comprising a sun gear, at least one planet gear rotatably mounted upon a planet carrier, and a ring gear.

10. A steering component according to claim 9 wherein the sun gear is connected to the driveshaft by way of the clutch mechanism, the planet carrier is connected to the drill string, and the ring gear is connected to the offsetting component.

11. A steering component according to claim 1 wherein the offsetting component is adapted to provide a variable offset.

12. A steering component according to claim 11 wherein the minimum offset is zero.

13. A steering component according to claim 1 in which the motor is a mud motor.

14. A steering assembly adapted for connection to a drill string, the assembly comprising a steering component, a drill bit and a motor to rotate the drill bit relative to the drill string, the steering component being located between the motor and the drill bit, the steering component comprising:

a rotatable driveshaft connected between the drill bit and the motor;

a first drive mechanism; and an offsetting component;

the first drive mechanism providing a rotatable connection between the drill string and the offsetting component whereby the drill string can rotate relative to the offsetting component, the first drive mechanism utilizing relative rotation between the driveshaft and drill string to drive the offsetting component to rotate in an opposed direction to the driveshaft wherein the steering assembly further comprises a second drive mechanism adapted to drive the offsetting component to rotate in the same direction as the driveshaft.

15. A method of steering a drill bit in a borehole with a steering component connected to a drill string, the steering component comprising a rotatable driveshaft, a drive mechanism and an offsetting component, the drive mechanism utilizing relative rotation between the driveshaft and the drill string to drive the offsetting component to rotate in an opposed direction to the driveshaft, the method comprising the steps of:

providing the drill string with a downhole motor for rotating the drill bit relative to the drill string;

connecting the downhole motor and the drill bit to opposed ends of the rotatable driveshaft;

operating the motor to drive the driveshaft and drill bit and drill a length of borehole;

determining a desired direction of curvature for the borehole and thereby determining a desired angular orientation for the offsetting component; measuring the rotation of the offsetting component induced by rotation of the driveshaft;

operating the drive mechanism to counter the induced rotation.

16. A method according to claim 15 wherein the drive mechanism is operated cyclically, whereby the offsetting component undergoes induced rotation in the direction of rotation of the driveshaft for a part of each cycle, and undergoes driven rotation in the opposed direction for the remaining part of each cycle, and whereby the offsetting component is caused to oscillate around its desired angular orientation.

* * * * *